US008348055B2

(12) United States Patent
Loban

(10) Patent No.: US 8,348,055 B2
(45) Date of Patent: Jan. 8, 2013

(54) MUSICAL INSTRUMENT CARRYING CASE AND STAND

(76) Inventor: Joseph Peter Loban, Chicago, IL (US)

( * ) Notice: Subject to any disclaimer, the term of this patent is extended or adjusted under 35 U.S.C. 154(b) by 285 days.

(21) Appl. No.: 12/709,668

(22) Filed: Feb. 22, 2010

(65) Prior Publication Data

US 2011/0203952 A1 Aug. 25, 2011

(51) Int. Cl.
*A45C 11/00* (2006.01)

(52) U.S. Cl. ..... 206/314; 206/45.2

(58) Field of Classification Search ..... 206/314, 206/14, 204, 45.23, 45.2; D3/204, 201; 84/421, 84/267, 290, 452 R, 453
See application file for complete search history.

(56) References Cited

U.S. PATENT DOCUMENTS 2,094,186 A * 9/1937 Patrick ..... 206/315.4
3,530,919 A * 9/1970 May ..... 206/315.4
4,778,136 A * 10/1988 Reimers ..... 248/96
5,833,051 A * 11/1998 Tiefenbrun et al. ..... 206/14
6,172,292 B1 * 1/2001 Dimbath ..... 84/453
6,441,288 B1 * 8/2002 Lin ..... 84/453
6,462,260 B2 * 10/2002 Fediakov ..... 84/327
6,505,762 B2 * 1/2003 Wilfer ..... 224/153
6,959,810 B2 * 11/2005 Neilson ..... 206/314
7,208,666 B2 * 4/2007 Burch et al. ..... 84/327
7,712,608 B2 * 5/2010 Leach ..... 206/314

* cited by examiner

*Primary Examiner* — J. Gregory Pickett
*Assistant Examiner* — Ernesto Grano
(74) *Attorney, Agent, or Firm* — SNR Denton US LLP

(57) ABSTRACT

A musical instrument carrying case and stand is disclosed. The carrying case and stand includes a case having a top side, a bottom side, a back side, and a front side having a vertical slit and a horizontal slit that collectively define a first flap and a front panel and a support element that is pivotally attached to the back side of the case to pivot between a first position in which the element is substantially parallel to the back of the case and a second position in which the element supports the case when the musical instrument is removed from the case. Additional embodiments may include first and second members attached to the back of the case where an end of the support element is pivotally attached between the first and second members, so that the element supports the case when the musical instrument is removed from the case.

17 Claims, 8 Drawing Sheets

106
102
100
112
110
120
122
104
114
140
116
132
134
130
144
136
146
109
142
108

106
100
124
102
122
112
120
104
110
140
114
116
134
132
130
144
136
146
d1
109
142
108

MUSICAL INSTRUMENT CARRYING CASE AND STAND

BACKGROUND OF THE INVENTION

The present invention relates broadly to a carrying case for a musical instrument. More particularly, the invention relates to a musical instrument carrying case that also functions as a stand, where the carrying case is comprised of a non-rigid material.

Professional and amateur players of guitar, banjo, violin, or other stringed instruments are extremely protective of their instruments, which are typically delicate and expensive devices. Damage to a stringed instrument often affects both the looks and the musical quality of the instrument (including the sound of the instrument and monetary value). Thus, professional and amateur players typically must take great care of their instruments, especially during transport or when the player is not using the instrument.

Typically, a stringed instrument is transported in a rigid or hard shell case for protection. These rigid or hard shell cases have handles for the player to carry the instrument much like a suitcase, which is typically not a comfortable means for manually carrying the instrument.

Non-rigid or soft shell bags or cases are commercially available and often equipped with straps for the player to comfortably carry the instrument on his or her back. However, non-rigid or soft shell bags or cases typically do not offer the protection that a rigid or hard shell case provides such that a player has to take extra care in setting down the non-rigid or soft shell bag or case containing the instrument on the floor, against a wall, or against a chair or other furniture.

When setting up for a performance, the player often uses a separate stand for the instrument that prevents the instrument from falling over and being damaged when not in use. Having an instrument stand in addition to a carrying case is an additional purchase and travel cost for the player. Moreover, having a separate stand and carrying case is an inconvenience for the player, who must transport both devices and, for each performance, expend time unpacking and setting up the stand, unpacking the instrument from the case, securing the instrument on the stand, and performing the reverse tasks when the performance is concluded.

Combination carrying cases and stands for musical instruments exist in the prior art as disclosed in, for example, U.S. Pat. Nos. 5,833,051, 6,462,260, 6,951,280 and 6,959,810. However, existing combination carrying cases and stands are typically formed with a rigid frame or hard shell case that is not comfortable for a player to manually carry and is more expensive than non-rigid or soft shell carrying cases or bags.

Therefore, a need exists for a combination carrying case and stand for a musical instrument that overcomes the problems noted above and others previously experienced with cases having a rigid frame or hard shell case.

SUMMARY OF THE INVENTION

In accordance with apparatus consistent with the present invention, a musical instrument carrying case and stand is provided that overcomes the problems noted herein with conventional carrying cases and stands. The case has a bottom side, a top side, a back side, and a front side that collectively define a cavity within the case to hold a musical instrument, such as a guitar. The case is formed from a non-rigid material. The front of the case has a vertical slit and a horizontal slit that collectively define a flap on the upper portion of the front of the case and a front panel on the lower portion. The horizontal slit is positioned to define a pocket within the case in the lower portion of the internal cavity. A support element is pivotally attached at a first end to the back of the case by which the support element pivots between a first position and a second position. In the first position, the support element is substantially parallel to the back of the case. In the second position, the second end of support element is at a second predetermined distance such that the support element supports the lower portion of the internal cavity of the case when the musical instrument is removed.

In one implementation, the second predetermined distance is set such that when the support element is in the second position, the support element maintains the back side of the case taut below the point where the first end of the support element is pivotally attached to the back side of the case and the pocket remains in an open position when the musical instrument is removed.

In another implementation, the vertical slit effectively intersects the horizontal slit to define the first flap and a second flap on the front of the case. In a further implementation, a first part and second part of a first fastening element may be attached to the first flap and the second flap, respectively. The first part may be adapted to selectively engage the second part to vertically fasten the first flap to the second flap. A third part of a second fastening element may be attached to the first flap; a fourth part of the second fastening element may be attached to the second flap; and a fifth part of the second fastening element may be attached to the front panel. The third and fourth parts may be adapted to selectively engage the fifth part to horizontally fasten the first and second flaps to the front panel. The first fastening element may be a first zipper with the first part and second part of the first fastening element being complementary teeth of the first zipper. The second fastening element may also be a second and a third zipper with the third part and a portion of the fifth part of the second fastening element being complementary teeth of the second zipper and with the fourth part and a remainder of the fifth part of the second fastening element being complementary teeth of the third zipper.

A further implementation may have a first member and a second member attached to the back of the case so that the first end of the support element is disposed between the first and second members. The support element, the second member, and the third member may each have a respective thickness and be planar. In this implementation, when the support element is in the first position, the support element, the first member, and the second member are substantially co-planar. The first and second members may also be positioned such that, when the second end of the support element is wider than the first end of the support element, the first and second members guide and horizontally retain the support element between the first and second members when the support element is in the first position.

A strap may also be attached between the back side of the case and the support element. When the support element is in the first position the strap causes the support element, the first member, and the second member to be co-planar. A third fastening element may also be attached to the back side of the case and the support element to selectively attach the support element to the back side of the case and cooperatively retain the support element in a co-planar position with the first and second members.

In accordance with apparatus consistent with the present invention, another embodiment of a musical instrument carrying case and stand is provided. The case has a bottom side, a top side, a back side, and a front side that collectively define an internal cavity configured to accommodate and enclose a musical instrument. The case is formed of a non-rigid material. A first member and a second member are each affixed to the back side of the case. A support element, having a first end and a second end, is pivotally attached to the first and second members at a first predetermined distance from the bottom of the case such that the support element pivots between a first position, in which the support element is substantially parallel with the back of the case, and a second position, in which the second end of the support element is at least a second predetermined distance away from the bottom of the case such that support element sufficiently supports the case when the musical instrument is removed from the case.

In one implementation, the front side of the case has a vertical slit and a horizontal slit that collectively define a first flap and a front panel, and the horizontal slit is disposed at the first predetermined distance from the bottom of the case so as to define a pocket within the case. The vertical slit may effectively intersect the horizontal slit to define a first flap and a second flap. Additionally, there may be a first fastening element having a first part and a second part. The first part may be attached to the first flap and the second part may be attached to the second flap. The first part may be adapted to selectively engage the second part to vertically fasten the first flap to the second flap. There may also be a second fastening element having a third part attached to the first flap, a fourth part attached to the second flap, and a fifth part attached to the front panel. The third part may be adapted to selectively engage a portion of the fifth part to horizontally fasten the first flap to the front panel and the fourth part may be adapted to selectively engage a remainder of the fifth part to horizontally fasten the second flap to the front panel.

Other systems, methods, features, and advantages of the present invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings.

DETAILED DESCRIPTION OF THE INVENTION

Reference will now be made in detail to implementations in accordance with products consistent with the present invention as illustrated in the accompanying drawings.

Musical instrument players take great pride and care in maintaining their instruments during transport and display. A hard-shell case, while protective, can be cumbersome and uncomfortable to carry. A combination soft-shelled case and stand for musical instruments provides a comfortable alternative for transporting a musical instrument and eliminates the need for carrying a separate stand. A soft-shelled carrying case and stand also provides a less expensive alternative to the hard-shelled cases and stands currently available. Other advantages of the present invention are disclosed or will become apparent in the description to follow.

Figure 1:
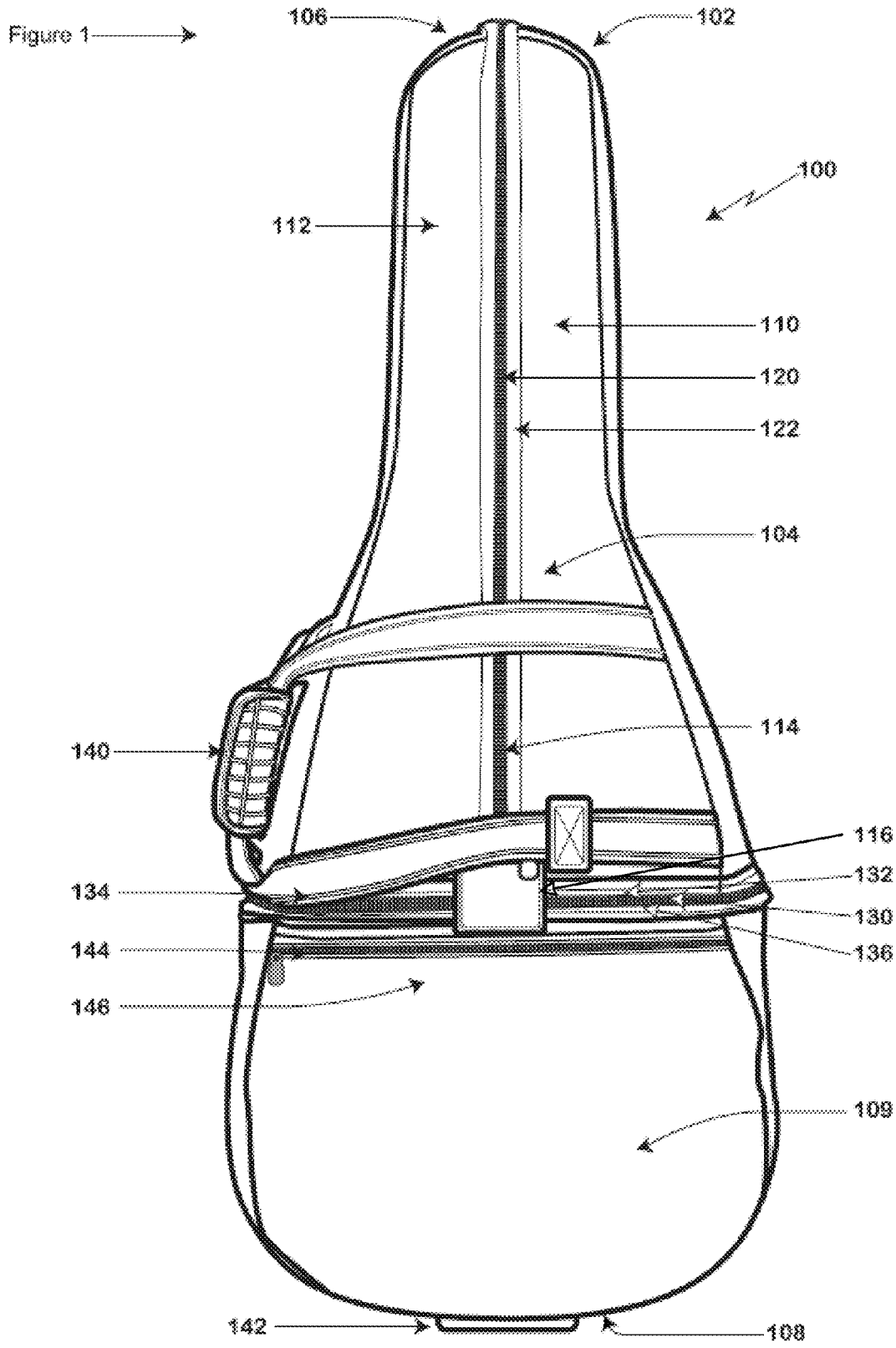
FIG. 1 is a front view of one embodiment of a musical instrument carrying case and stand consistent with the present invention.
Figure 2:
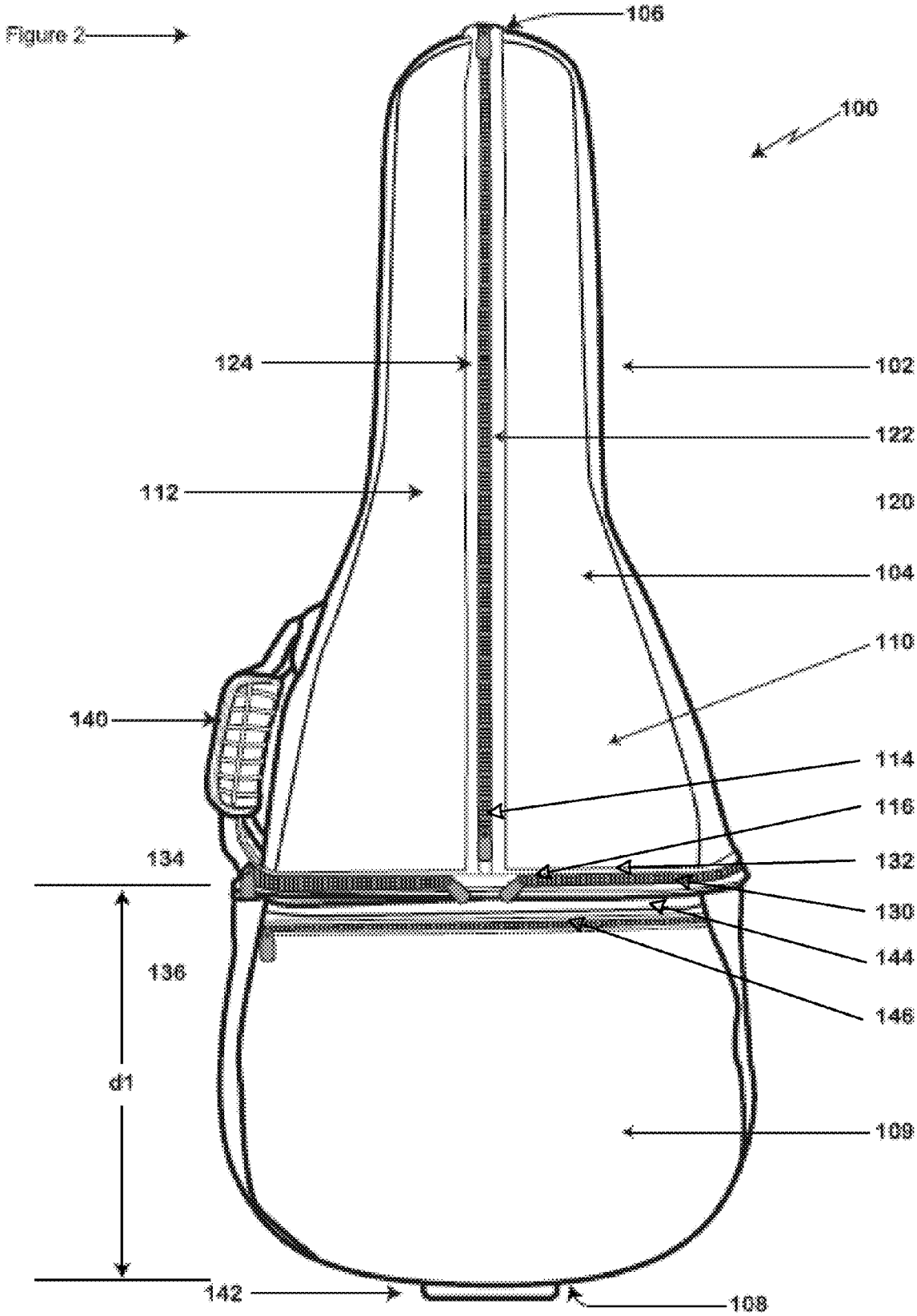
FIG. 2 is a front view of the musical instrument carrying case and stand of FIG. 1 showing vertical and horizontal slits and corresponding fastening elements of the carrying case for enclosing the musical instrument within the case.
Figure 3:
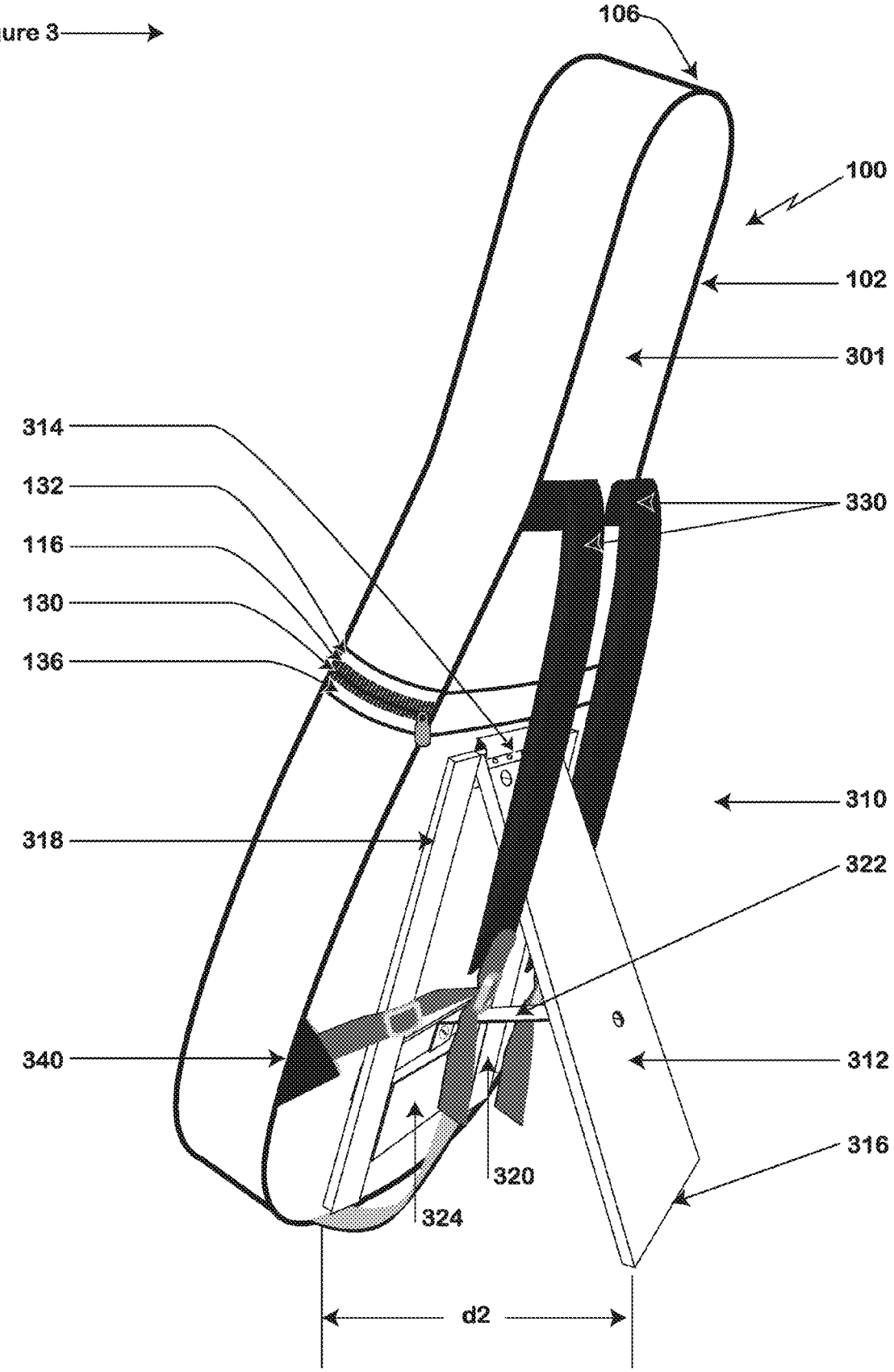
FIG. 3 is a perspective rear view of the musical instrument carrying case and stand of FIG. 1 showing the stand in a case supporting position in accordance with the present invention.
Figure 4A:
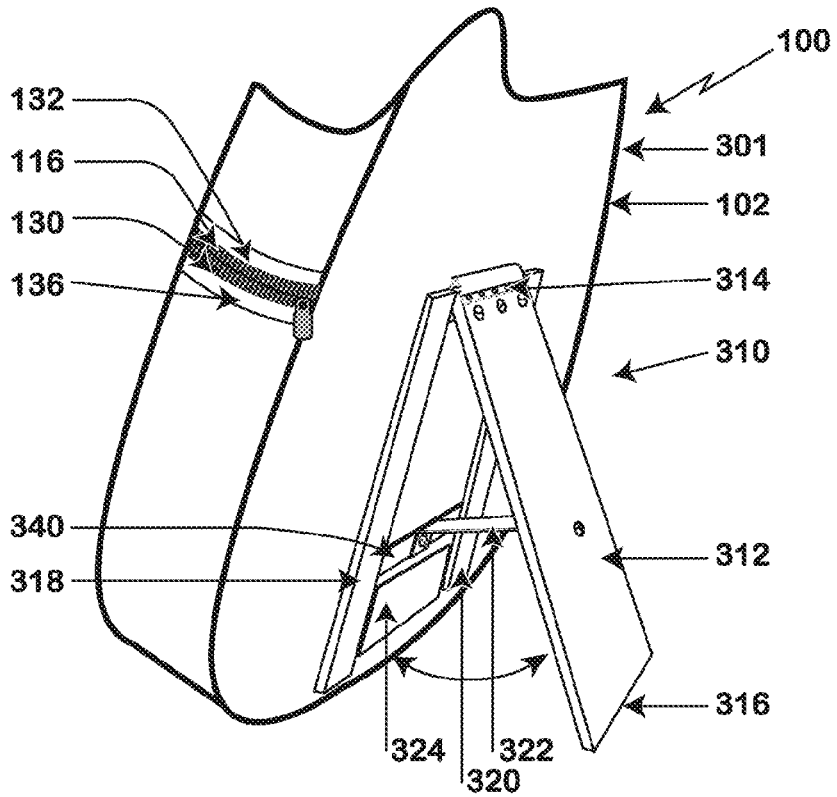
FIG. 4A is an enlarged perspective view of the bottom portion of the musical instrument carrying case and stand of FIG. 1, showing the stand in the case supporting position with other components of the case removed to avoid obscuring the stand.
Figure 4B:
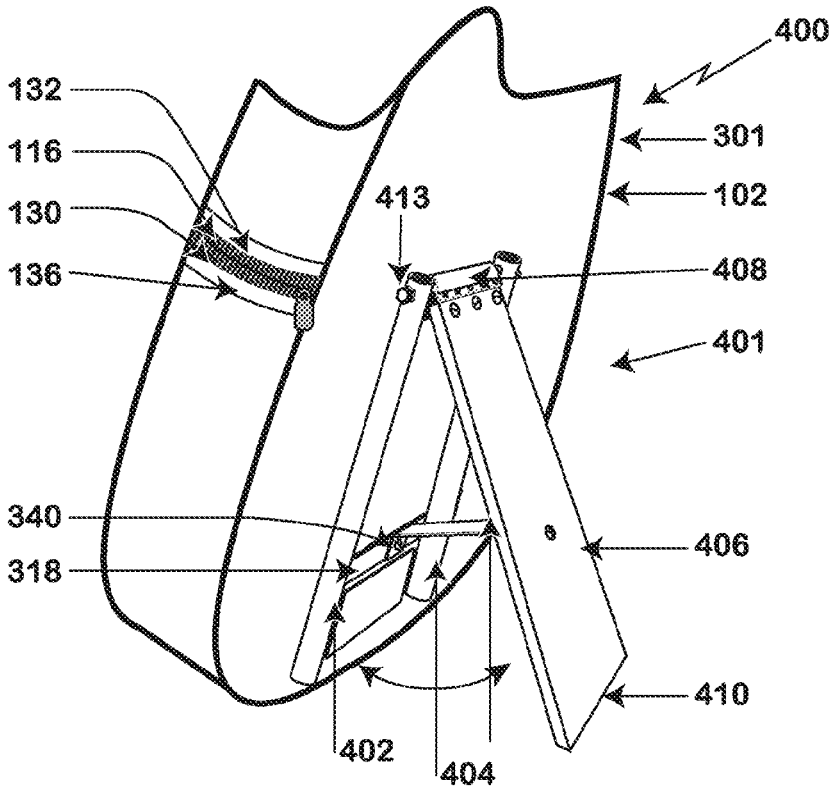
FIG. 4B is a perspective view of a bottom portion of a second embodiment of a musical instrument carrying case consistent with the present invention.
Figure 5:
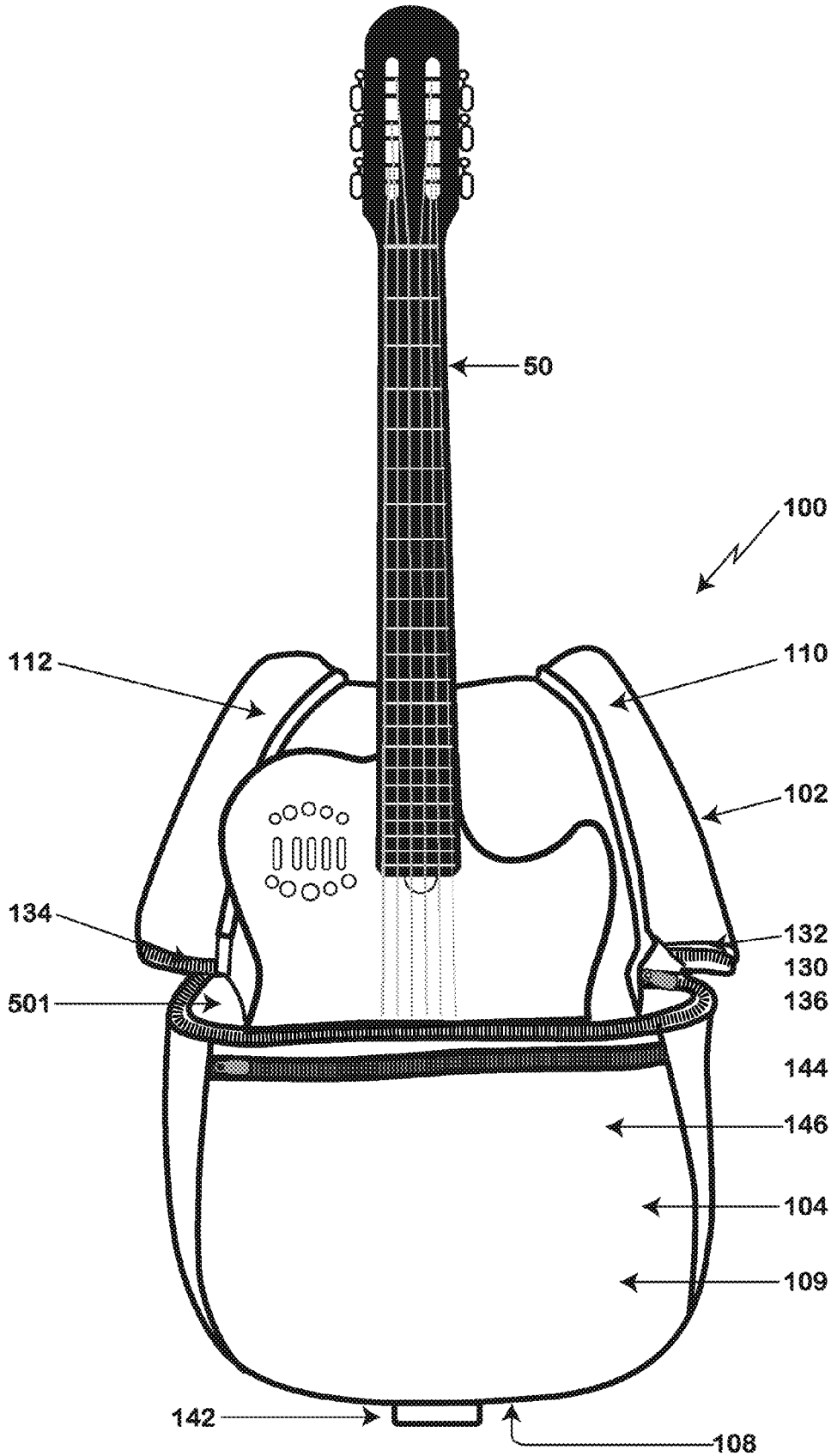
FIG. 5 is a front view of the musical instrument carrying case and stand of FIG. 1, showing a pocket in the case for holding the instrument upright in cooperation with the stand in accordance with the present invention.
Figure 6:
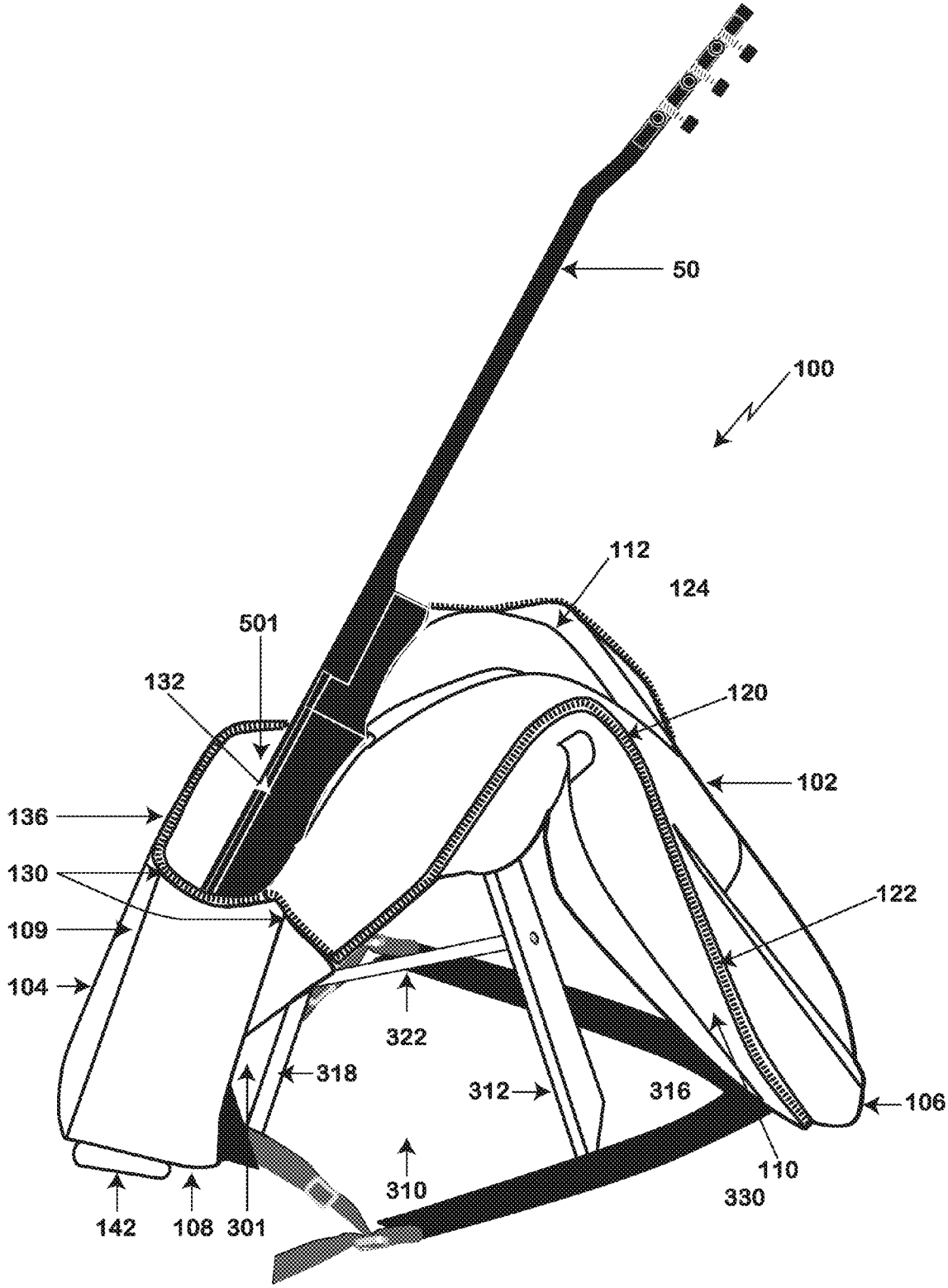
FIG. 6 is a side view of the musical instrument carrying case and stand of FIG. 1, showing the pocket in the case in an open position and the stand supporting the case in accordance with the present invention such that the pocket remains in the open position.
Figure 7:
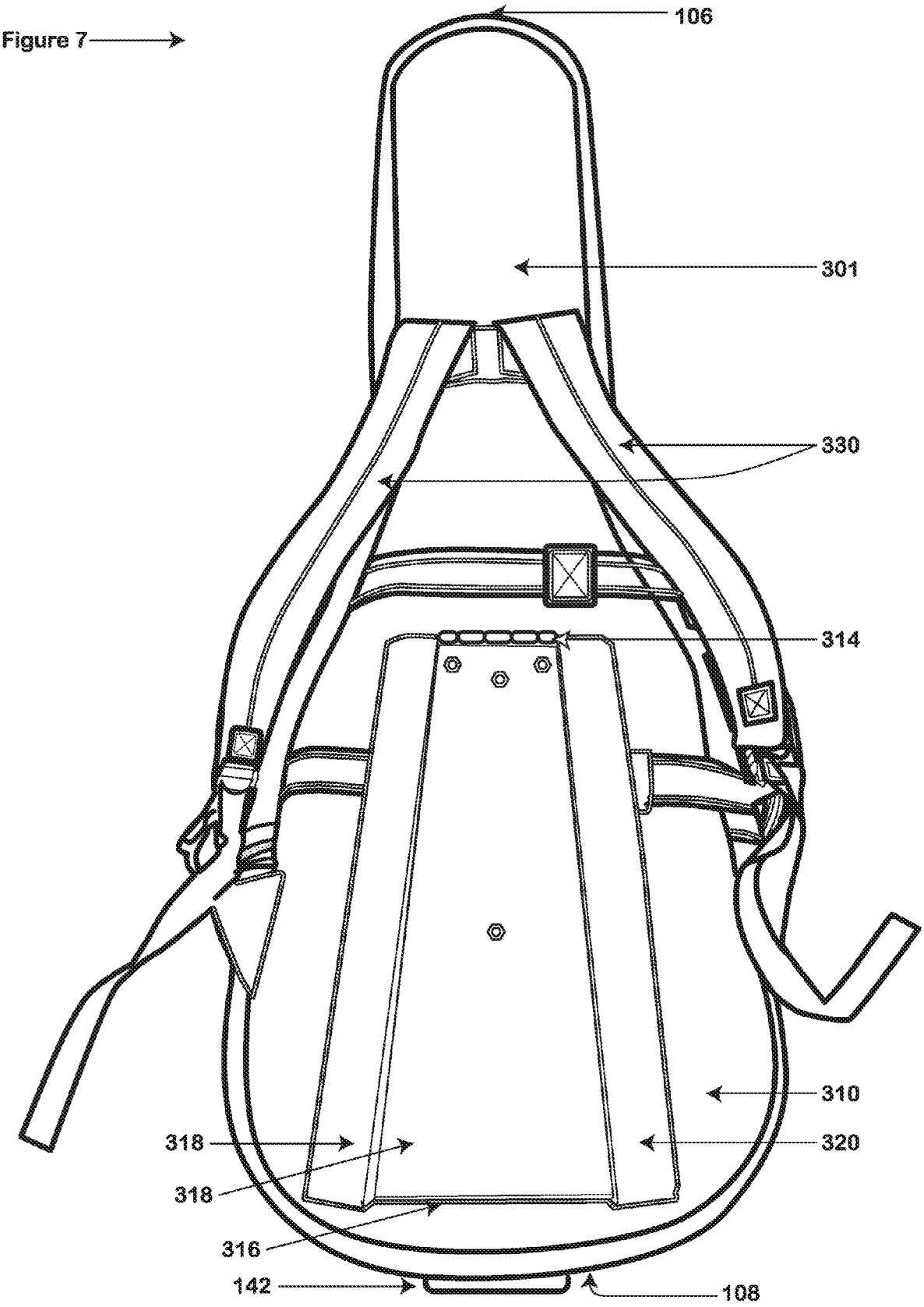
FIG. 7 is a rear view of the musical instrument carrying case and stand of FIG. 1, showing the stand in a carrying position in accordance with the present invention.

FIGS. 1-4A and 5-8 depict one exemplary musical instrument carrying case and stand 100 consistent with the present invention (also referenced as "carrying case and stand 100"). FIGS. 1 and 2 depict front views of the musical instrument carrying case and stand 100 in which the musical instrument (referenced as "50") is enclosed within the case 102 and made accessible in accordance with the present invention as described herein. FIGS. 3 and 4A depict a rear view of the musical instrument carrying case and stand 100 showing the stand 310 in a case supporting position consistent with the present invention where the musical instrument 50 is enclosed within the case 102. FIGS. 5 and 6 depict a front and side view of the musical instrument carrying case and stand 100 showing a pocket 501 in the case 102 for holding the musical instrument 50, such as a guitar, upright in cooperation with the stand 310 in accordance with the present invention when the instrument 50 is not being used. FIG. 7 depicts a rear view of the musical instrument carrying case and stand 100 showing the stand 310 in a carrying position for a user to comfortably transport the carrying case and stand 100 as reflected in FIG. 8.

The carrying case and stand 100 has a case 102 that has a front side 104, a back side 301 (as shown in FIG. 3), a top side 106, and a bottom side 108. The sides 104, 301, 106, and 108 of the case 102 collectively define an internal cavity that accommodates a musical instrument 50. The bottom portion of the internal cavity is the pocket 501, shown in FIG. 5. The top portion of the internal cavity is the portion above the pocket 501, which may be accessed via front panel flaps 110 and 112 as further discussed herein.

The carrying case and stand 100 is illustrated for carrying and supporting guitars as the musical instrument 50. However, one of ordinary skill in the art, having reviewed the present application, will appreciate that the carrying case and stand 100 may be employed for carrying other musical instruments, e.g., banjos, violins, saxophones, cellos, or trombones.

The case 102 is made from a sufficient non-rigid material that may include leather, cloth, nylon, or other non-rigid materials that lack support to keep the case 102 in an upright or standing position without a rigid skeletal structure or external frame. Thus, without the present invention, a non-rigid case would collapse to the floor when a musical instrument is removed from the case.

The front side 104 of the case 102 has a vertical slit 114 and horizontal slit 116 that collectively define a front panel 109 and a first flap 110. The vertical slit 114 and horizontal slit 116 are represented by zippers (i.e. fastening elements 120 and 130) in FIGS. 1 and 2. In FIG. 2, the zippers 120 and 130 are shown partially unzipped to reflect the vertical slit 114 and the horizontal slit 116 that provide access to the internal cavity of the carrying case and stand 100, so that the musical instrument 50 may be removed from or replaced therein while the stand 310 is in the supporting position as described herein. The horizontal slit 116 is disposed at a first predetermined distance (d1) from the bottom side 108 of the case 102 to define a pocket 501 (shown in FIG. 5) within the case 102 at a lower portion of the internal cavity. When the vertical slit 114 and the horizontal slit 116 are closed as shown in FIG. 1, the musical instrument 50 is enclosed and retained within the case 102. When the vertical slit 114 and the horizontal slit 116 are opened, as reflected in FIGS. 2 and 5, the musical instrument 50 can be removed from or replaced in the case 102.

In one implementation, the vertical slit 114 effectively intersects the horizontal slit 116 to define a first flap 110 and a second flap 112, as shown in FIG. 2. When the vertical slit 114 and the horizontal slit 116 are opened, the first flap 110 and the second flap 112 can be folded down to expose the musical instrument 50 within, as depicted in FIG. 5. The musical instrument 50 can then be easily removed from the pocket 501 within the case 102 for the user to play. Additionally, with the first flap 110 and the second flap 112 folded down, the user can also display the musical instrument 50 while it is in the non-rigid case 102 and supported by the stand 310 (as shown in FIG. 3) in accordance with the present invention. This is particularly useful when a user is performing and needs to swap instruments or to take a break between songs or before or after a show. Thus, without the present invention, a user desiring to remove a musical instrument from a case or display the musical instrument in the case would have to open the entirety of the case to do so, exposing the musical instrument to potential damage. Additionally, with the case 102 supported by the stand 310 (shown in FIG. 3), a user may more easily remove the musical instrument 50 from the case 102 without having to lay the case 102 on the ground to do so.

The vertical slit 114 and the horizontal slit 116 may have fastening elements 120 and 130 (shown in FIGS. 1-6 and 8 as zippers) to partially or completely close both slits 114 and 116. In this implementation, the first fastening element 120 may be comprised of a first part 122 attached to the first flap 110 on the front side 104 of the case 102, and a second part 124 attached to the second flap 112 on the front side 104 of the case 102, where the first and second parts 122 and 124 may be selectively engaged to close the vertical slit 114. When the first part 122 and the second part 124 are engaged or fastened, the musical instrument 50 is more securely retained within the case 102.

In the implementation shown in the figures, the first fastening element 120 is a zipper. In this implementation, the first part 122 and the second part 124 are the complementary teeth for the zipper. However, the first and second parts 122 and 124 of the first fastening element 120 may be formed from complementary hook and loop fasteners (or Velcro parts), buttons and corresponding button holes, complementary snap fasteners, or other fastening elements that can be engaged or disengaged by the user to allow access into the internal cavity of the case 102.

In the implementation shown in the figures, the second fastening element 130 is comprised of three parts 132, 134, and 136 that enable the two flaps 110 and 112 to be selectively engaged to the lower front panel 109. The second fastening element 130 is adapted to selectively close the horizontal slit 116. In this implementation, the third part 132 is attached to the first flap 110; the fourth part 134 is attached to the second flap 112; and the fifth part 136 is attached to the front panel 109. When the third part 132 and a portion of the fifth part 136 and the fourth part 134 and a remainder of the fifth part 136 are fastened to partially or completely close the horizontal slit 116, the musical instrument 50 is more securely retained within the case 102.

The second fastening element 130 may also be a zipper as shown in the figures. In this implementation, the third part 132, the fourth part 134, and the fifth part 136 are the complementary teeth for the zipper. However, the second fastening element 130 may be complementary hook and loop fasteners (or Velcro parts), buttons and corresponding button holes, complementary snap fasteners, or other fastening elements that can be engaged or disengaged by the user to allow access into the internal cavity of the case 102.

Additional features may also be added to the case 102. For example, a handle 140 may be attached to the case 102 to allow a user to carry the musical instrument carrying case and stand 100 by hand in a horizontal position. A foot stop 142 may also be attached to the bottom side 108 of the case 102 to further maintain the case 102 in an inclined or upright position or to prevent the case 102 from sliding on slick surfaces. The foot stop 142 may be made from rubber, wood, metal coated with rubber, or any other material that can assist the case 102 in resisting any sliding while in the inclined or upright position. The foot stop 142 may also be angled to cooperatively maintain the case 102 in a slightly angled, but upright, position with the stand 310.

A front pocket 146 may also be included on the front panel 109 on the front side 104 of the case 102 for storing accessories for the musical instrument 50 or any other items, such as sheet music or guitar picks. This front pocket 146 may be secured by a fourth fastening element 144, such as a zipper as shown in FIGS. 1, 2, and 5, to selectively close the pocket 144. Carrying straps 330 (shown in FIG. 3) may be attached to the case 102 to allow users to transport the carrying case and stand 100 on their backs.

FIGS. 3 and 4A depict the rear view of the musical instrument carrying case and stand 100 consistent with the present invention. The stand 310 is attached to the back side 301 of the case 102. The stand 310 includes a support element 312 having a first end 314 and a second end 316 The first end 314 is pivotally attached to the back side 301 of the case 102. In FIGS. 3 and 4A, an exemplary pivotal attachment is shown as a hinge that is affixed to the non-rigid material of the carrying case 102, via adhesive, rivets, stitching, or other fastening means. The support element 312 may be made from metal, composites, plastics, wood, or any other rigid material capable of supporting the case 102 in an upright or inclined position with a musical instrument 50 inside. When the carrying case and stand 100 is being transported, the support element 312 may be pivoted about the first end 314 to a first or carrying position where the support element 312 is substantially parallel with the back side 301 of the case 102. Alternatively, when the non-rigid carrying case 102 needs to be positioned in an upright or inclined position for access to the musical instrument 50 therein, the support element 312 can be pivoted to a second or supporting position. For this second position, the support element 312 of the stand 310 may be pivoted about the first end 314 so that the second end 316 of the support element 312 may be set at a second predetermined distance (d2) away from the case 102 (i.e. the "supporting position"), where the support element 312 supports the lower portion of the case 102, or pocket 501, and maintains the back of the lower part of the case 102 taut below the point where the first end 314 of the support element 312 is pivotally attached to the back side 301. When the lower part of the case 102 is taut, the pocket 501 (shown in FIG. 5) remains in an open position without the musical instrument 50 being disposed therein.

In one implementation, the second end 316 of the support element 312 is at least one inch wider than the first end 314, which adds stability to the carrying case and stand 100 when the stand 310 is deployed in the supporting position to keep the case 102 in an upright or inclined position. The second end 316 may have or incorporate a foot stop (e.g., a rubber end or stop) to further prevent the support element 312 from sliding.

A further implementation of the stand 310 may also include a first member 318 and a second member 320 attached to the back side 301 of the case 102. In this implementation, the support element 312 is disposed between first member 318 and second member 320, so that the first member 318 and the second member 320 can guide and horizontally retain the support element 312. These additional members 318 and 320 can provide extra rigidity to the back side 301 of the case 102 and can further stabilize the carrying case and stand 100 when used in an upright position. The first member 318 and the second member 320 may be made from materials such as metal, composites, plastics, wood, or other rigid materials. The support element 312, the first member 318, and the second member 320 may also each have a thickness such that each is co-planar with the others.

In another implementation, the stand 310 may have a strap 322 attached between the support element 312 and the back side 301 of the case 102. The strap 322 may be made from nylon, rope, cloth, rubber, or any other pliable material that can limit the distance the support element 312 can be pivoted to. Accordingly, the strap 322 may be used to limit the distance of the support element 312 to the predetermined distance (d2) away from the case 102 that will support the non-rigid case 102 with or without the musical instrument 50 inside. The strap 322 may be flattened and folded upon itself when the support element 312 is pivoted to the first or carrying position. In particular, when the support element 312 is pivoted to the first or carrying position, the strap 322 may be folded between the back side 301 of the case 102 and the support element 312.

In one embodiment, the support element 312 has a first thickness and each of the first and second members 318 and 320 have a second thickness that is greater than the first thickness.

Figure 8:
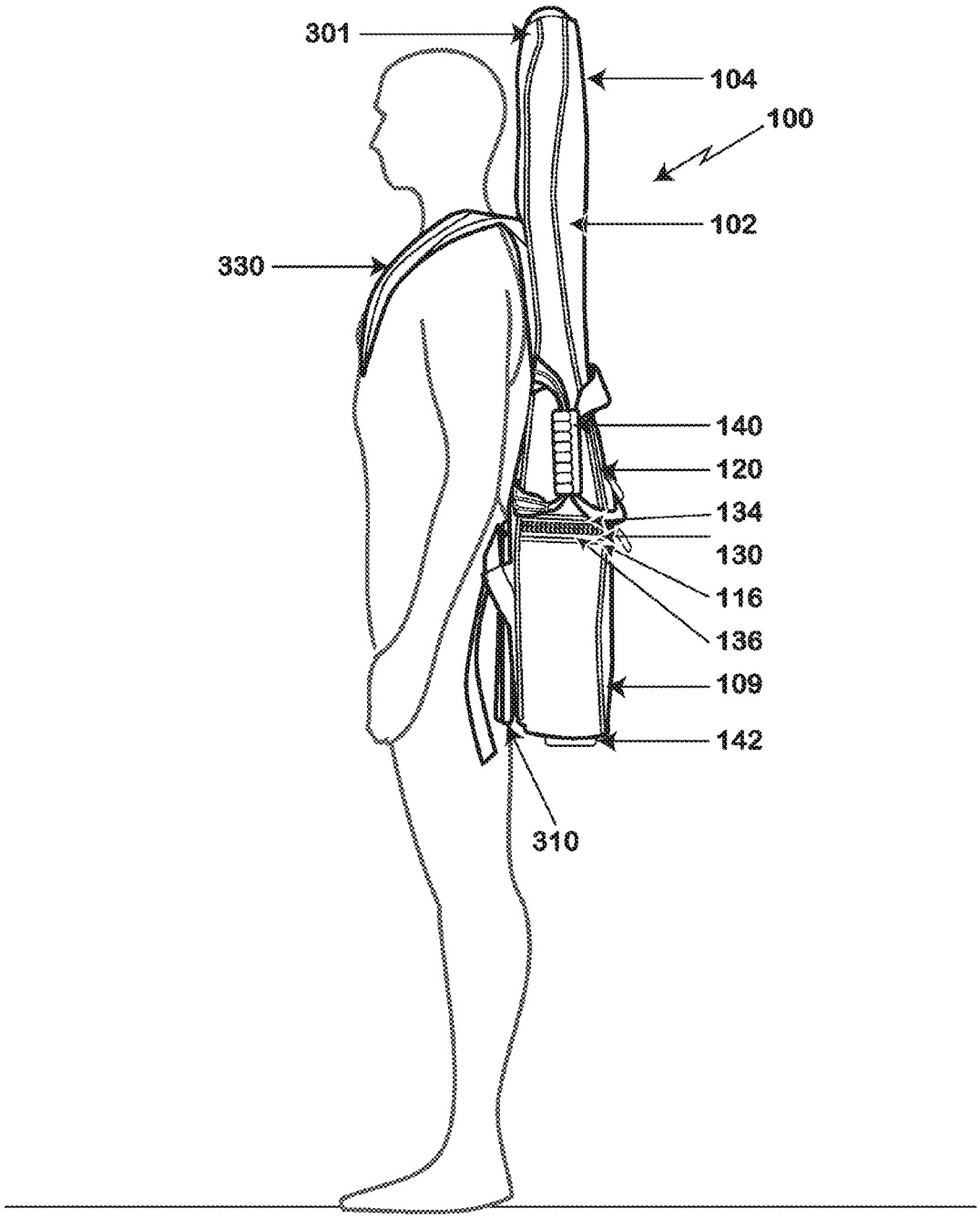
FIG. 8 is a side view of the musical instrument carrying case and stand of FIG. 1 as carried by a user in accordance with the present invention.

In this embodiment, when the support element 312 is pivoted to the first or carrying position, the strap 322 folds upon itself to have a third thickness such that the outer surface of the support element 312 is substantially co-planar (e.g. within 0 to ⅛ in.) of the outer surface of the first and second members 318 and 320. This co-planar embodiment enables the stand 310 to be comfortably pressed against a user's back when the carrying case and stand 100 is carried by the user as shown in FIG. 8.

A strap anchor 340 may also be attached to the back side 301 of the case 102 to which the strap 322 is attached instead of attaching the strap 322 directly to the back side 301 of the case 102. This can reduce the potential wear on the non-rigid case 102 when the support element 312 is pivoted many times and the strap 322 pulls on the non-rigid material of the case 102.

In a further implementation, the stand 310 may also have a third fastening element 324 attached to the back side 301 of the case 102 and the support element 312. This third fastening element 324 may be adapted to selectively attach the support element 312 to the back side 301 of the case 102. The third fastening element 324 retains the support element 312 against the back side 301 of the case 102 when the carrying case and stand 100 is being transported or stored. The third fastening element 324 may be a hook and loop fastener, snap fastener, or any other fastener that can be selectively engaged and disengaged.

FIGS. 5 and 6 depict the carrying case and stand 100 with the vertical slit 114 and the horizontal slit 116 opened and the first flap 110 and the second flap 112 folded down to expose the musical instrument 50 within the non-rigid case 102, consistent with the present invention. With the flaps 110 and 112 folded down, the user can easily remove the musical instrument 50 from the pocket 501 of the case 102. When the musical instrument 50 is removed, the pocket 501 does not collapse with the stand 310 in the supporting position, as described herein. This allows the user to put the musical instrument 50 back into the pocket 501 of the non-rigid case 102 without lying the non-rigid case 102 down or manually holding the non-rigid case 102 upright. Thus, without the present invention, a non-rigid case would collapse the pocket and the musical instrument could not be easily replaced into the case.

FIG. 4B depicts the stand 401 of a second embodiment of a carrying case and stand 400 consistent with the present invention. The case 102 and other components included on the front side 104 of the case 102 may be the same or consistent with those described for the carrying case and stand 100 of the first embodiment. In the embodiment shown in FIG. 4B, a first member 402 and a second member 404 are attached to the back side 301 of the case 102. The first member 402 and the second member 404 may be made from materials such as metal, composites, plastics, wood, or other rigid materials. A support element 406, having a first end 408 and a second end 410, is pivotally attached between the first member 402 and the second member 406 at the first end 408. The support element 406 may also be made from materials such as metal, composites, plastics, wood, or other rigid materials. In this embodiment, the support element 406 is pivotally attached by a rod 413 that spans through the first end 408 of the support element 406 and between the first member 402 and the second member 404.

A user can use the carrying case and stand 100 to store their musical instrument 50 inside when transporting the musical instrument 50 from one performance to the next. Once the user arrives at the destination, the user can then pivot the support element 312 to the second position to keep the non-rigid case 102 in an upright or inclined position with the lower portion of the non-rigid case 102 taut between the pivot point of the first end 314 of the support element 312 so that the pocket 501 in the lower portion of the non-rigid case 102 is maintained in an open position. The integrated stand 310 with the case 102 reduces the number of items a music player needs to transport when traveling with their musical instrument. Additionally, the non-rigid case material reduces the weight and cost as compared to other rigid instrument cases with stands. When the user desires to either display their instrument or play their instrument, the vertical slit 114 and horizontal slit 116 can be opened. The first flap 110 and the second flap 112 can then be folded down to expose or display the musical instrument 50. The user can then remove the musical instrument 50 from the pocket 501 and the pocket 501 will not collapse. When the user is done playing, the musical instrument 50 can be returned to the pocket 501 to effectively maintain the musical instrument 50 in an upright position while the musical instrument 50 is not in use. When the user is ready to transport the musical instrument 50 to a new location, the user can fold up the first flap 110 and the second flap 112, close the vertical slit 114 and the horizontal slit 116, pivot the support element 312 to the first position, and carry the case 102 holding the musical instrument 50 either by the handle 140 or the carrying straps 330.

In one implementation, padding (such as foam or stiff fabric) may be disposed in the bottom, internal corners of the pocket 501 to provide further support for the musical instrument 50 when the carrying case and stand 100 is positioned in a reclined or upright position as described herein. In addition, the case 102 may include other structural materials such as boning elements in the fabric used to form the case 102.

While various embodiments of the present invention have been described, it will be apparent to those of skill in the art that many more embodiments and implementations are possible that are within the scope of this invention. Accordingly, the present invention is not to be restricted except in light of the attached claims and their equivalents.

What is claimed is:

1. A musical instrument carrying case and stand, comprising:

a case having a bottom side, a top side, a back side, and a front side that collectively define an internal cavity configured to accommodate and enclose a musical instrument, the case being formed from a non-rigid material, the case and internal cavity having a first portion in which can be accommodated a main body portion of a string instrument and a second elongate portion in which can be accommodated an elongated neck portion of the string instrument;

the front side having a vertical slit and a horizontal slit that collectively define a first flap and second flap both of which are disposed above the horizontal slit and a front panel disposed below the horizontal slit, the horizontal slit disposed at a first predetermined distance from the bottom of the case so as to define a pocket within the case corresponding to a lower portion of the internal cavity;

a first fastening element having a first part being attached to the first flap and a second part being attached to the second flap, and the first part being adapted to selectively engage the second part to vertically fasten the first flap to the second flap;

a second fastening element having a third part attached to the first flap, a fourth part attached to the second flap, and a fifth part attached to the front panel, the third part being adapted to selectively engage the fifth part to horizontally fasten the first flap to the front panel, the fourth part being adapted to selectively engage the fifth part to horizontally fasten the second flap to the front panel straps secured to the back side of the case to enable the case to be worn as a backpack by a person;

a first member and a second member affixed to the back side of the case and extending generally along the direction of the vertical slit and generally orthogonal to the horizontal slit; each of the first and second member being rigid and a support element having a first end and a second end, the first end being pivotally attached to the back side at a point, wherein the support element pivots between a first position in which the support element is substantially parallel with the back of the case and a second position in which the second end of the support element is at least a second predetermined distance away from the bottom of the case such that the support element supports the lower portion of the internal cavity of the case when the musical instrument is removed from the pocket, wherein, the second predetermined distance is set such that when the support element is in the second position, the support element, the first member and the second member cooperate to maintain the back side of the case in a sufficiently rigid and substantially upright manner so that, when the vertical and horizontal slits are open, (a) the pocket remains in an open position and (b) the case and stand provide a instrument stand in which the string instrument can be stored openly accessible in a substantially upright position.

2. A musical instrument carrying case and stand according to claim 1, wherein the first fastening element is a first zipper, the first and second parts are complementary teeth of the first zipper, the second fastening element is a second zipper and a third zipper, and the third part and a portion of the fifth parts are complementary teeth of the second zipper and the fourth part and a remainder of the fifth parts are complementary teeth of the third zipper.

3. A musical instrument carrying case and stand according to claim 1, wherein the second end of the support element is at least one inch wider than the first end of the support element.

4. A musical instrument carrying case and stand according to claim 1, wherein the first end of the support element is disposed between the first and second members.

5. A musical instrument carrying case and stand according to claim 4, wherein the support element, the first member, and the second member each have a respective thickness and are planar and, when the support element is in the first position, the support element, the first member, and the second member are substantially coplanar.

6. A musical instrument carrying case and stand according to claim 4, wherein the second end of the support element is wider than the first end of the support element, and the first member and second member are positioned so as to guide and horizontally retain the support element between the first member and the second member when the support element is in the first position.

7. A musical instrument carrying case and stand according to claim 4, further comprising a strap attached between the back side of the case and the support element such that when the support element is in the first position the strap causes the support element, the first member, and the second member to be coplanar.

8. A musical instrument carrying case and stand according to claim 4, further comprising a third fastening element attached to the back side of the case and to the support element to selectively attach the support element to the back side of the case, wherein the third fastening element cooperatively retains the support element in a coplanar position with the first and second members.

9. A musical instrument carrying case and stand according to claim 8, wherein the third fastening element is a hook and loop fastener.

10. A musical instrument carrying case and stand according to claim 1, wherein the second predetermined distance is set such that when the support element is in the second position, the case is disposed at an incline that maintains the pocket in an open position.

11. A musical instrument carrying case and stand, comprising:

a case having a bottom side, a top side, a back side, and a front side that collectively define an internal cavity configured to accommodate and enclose a musical instrument, the case being formed from a non-rigid material, the case and internal cavity having a first portion in which can be accommodated a main body portion of a string instrument and a second elongate portion in which can be accommodated an elongated neck portion of the string instrument;

a relatively vertical slit extending down the elongate portion and a relative horizontal slit with which the relatively vertical slit intersects that collectively define at least a first flap disposed above the horizontal slit and a front panel disposed below the horizontal slit, the horizontal slit disposed at a first predetermined distance from the bottom of the case so as to define a pocket within the case corresponding to a lower portion of the internal cavity;

first and second fastening elements with which the relatively vertical slit is selectively closed, third and fourth fastening elements with which the relatively horizontal slit is selectively closed;

straps secured to the back side of the case to enable the case to be worn as a backpack by a person;

a first member and a second member affixed to the back side of the case and extending generally along the direction of the vertical slit and generally orthogonal to the horizontal slit; each of the first and second member being rigid and a support element having a first end and a second end, the first end being pivotally attached to the back side at a point, the support element pivoting between a first position in which the support element is substantially parallel with the back of the case and a second position in which the second end of the support element is at least a second predetermined distance away from the bottom of the case such that the support element supports the lower portion of the internal cavity of the case when the stringl instrument is removed from the pocket, wherein, the second predetermined distance is set such that when the support element is in the second position, the support element , the first member and the second member cooperate to maintain the back side of the case in a sufficiently rigid and substantially upright manner so that, when the relatively vertical and horizontal slits are open, (a) the pocket remains in an open position and (b) the case and stand provide an instrument stand in which the string instrument can be stored openly accessible in a substantially upright position.

12. The musical instrument carrying case of claim 11, wherein at least one of the fastening elements with which at least one of the relatively vertical slit and the relatively horizontal slit is selectively closed comprise a zipper.

13. The musical instrument carrying case of claim 11, wherein at least one of the fastening elements with which at least one of the relatively vertical slit and the relatively horizontal slit is selectively closed comprise hook and loop fastener parts.

14. A musical instrument carrying case and stand according to claim 11, wherein the first end of the support element is disposed between the first and second members.

15. A musical instrument carrying case and stand according to claim 14, wherein the support element, the first member, and the second member each have a respective thickness and are planar and, when the support element is in the first position, the support element, the first member, and the second member are substantially coplanar.

16. A musical instrument carrying case and stand according to claim 14, wherein the second end of the support element is wider than the first end of the support element, and the first member and second member are positioned so as to guide and horizontally retain the support element between the first member and the second member when the support element is in the first position.

17. A musical instrument carrying case and stand according to claim 14, further comprising a strap attached between the back side of the case and the support element such that when the support element is in the first position the strap causes the support element, the first member, and the second member to be coplanar.

* * * * *